US011573592B1

(12) United States Patent
Wang et al.

(10) Patent No.: US 11,573,592 B1
(45) Date of Patent: Feb. 7, 2023

(54) ONE-HANDED JOYSTICK WITH ADAPTIVE CONTROL

(71) Applicants: ZOOMLION Heavy Industry NA, Inc., Yorkville, WI (US); ZOOMLION Heavy Industry Science and Technology Co. Ltd., Changsha (CN)

(72) Inventors: Shu Wang, Yorkville, WI (US); Matthew P. Seeger, Franksville, WI (US)

(73) Assignees: ZOOMLION HEAVY INDUSTRY NA, INC., Yorkville, WI (US); ZOOMLION HEAVY INDUSTRY SCIENCE AND TECHNOLOGY CO. LTD, Changsha Hunan Province (CN)

( * ) Notice: Subject to any disclaimer, the term of this patent is extended or adjusted under 35 U.S.C. 154(b) by 0 days.

(21) Appl. No.: 17/712,669

(22) Filed: Apr. 4, 2022

Related U.S. Application Data

(63) Continuation-in-part of application No. 17/404,262, filed on Aug. 17, 2021, now Pat. No. 11,449,089.

(51) Int. Cl.
*G05G 9/04* (2006.01)
*E02F 9/20* (2006.01)
(Continued)

(52) U.S. Cl.
CPC ..... *G05G 9/047* (2013.01); *E02F 9/2004* (2013.01); *E02F 9/22* (2013.01);
(Continued)

(58) Field of Classification Search
CPC ..... G05G 9/047; G05G 9/04737; G05G 2009/0474; G05G 2009/04744;
(Continued)

(56) References Cited

U.S. PATENT DOCUMENTS 3,028,126 A * 4/1962 Holleman ..... G05G 1/62 244/236
3,573,412 A * 4/1971 Uhrich ..... H01H 17/00 200/329
(Continued)

FOREIGN PATENT DOCUMENTS

DE 112014000127 T5 * 6/2015 ..... E02F 3/435
EP 2028320 A1 * 2/2009 ..... E02F 9/2004
(Continued)

OTHER PUBLICATIONS

Machine translation of DE 102014012284 A1 obtained on Oct. 25, 2022.*
Machine translation of DE 19802983 A1 obtained on Oct. 25, 2022.*

*Primary Examiner* — Adam D Rogers
(74) *Attorney, Agent, or Firm* — Donald J. Ersler

(57) ABSTRACT

An adaptive joystick preferably includes a rotatable cylinder bar, an outer base ring, an inner ring and an industrial joystick base. An adaptive controller receives an output from the adaptive joystick and outputs a control signal to a valve solenoid to control a hydraulic cylinder. Angle, depth and pressure sensors are preferably used to monitor a position of the hydraulic cylinder. The sensor outputs are fed into the adaptive controller. An inward wrist curl of the rotatable cylinder bar combined with a forearm pull rearward of the outer base ring are used to cause a digging motion. An outward wrist curl of the rotatable cylinder bar combined with a forearm push forward of the outer base ring are used to cause a dumping motion. A hand movement to the left is associated with swinging the excavator left. A hand movement to the right is associated to swinging the excavator right.

10 Claims, 8 Drawing Sheets

(51) Int. Cl.
*G05G 9/047* (2006.01)
*E02F 9/22* (2006.01)

(52) U.S. Cl.
CPC ..... *G05G 2009/0474* (2013.01); *G05G 2009/04744* (2013.01); *G05G 2009/04748* (2013.01); *G05G 2009/04781* (2013.01)

(58) Field of Classification Search
CPC ..... G05G 2009/04748; G05G 2009/04774; G05G 2009/04781; G05G 5/02; G05G 5/03; H01H 25/04; H01H 2025/043; H01H 2025/045; E02F 9/2004; E02F 9/2012; E02F 9/22; B60K 2026/029
See application file for complete search history.

(56) References Cited

U.S. PATENT DOCUMENTS 5,223,776 A 6/1993 Radke et al.
5,446,980 A * 9/1995 Rocke ..... E02F 3/439 701/50
6,793,653 B2 * 9/2004 Sanchez ..... A61B 34/77 606/1
6,880,855 B2 * 4/2005 Chernoff ..... B60W 30/18181 74/552
7,113,836 B2 9/2006 Hornig
7,148,819 B2 * 12/2006 Kim ..... G05G 9/04737 341/20
8,135,518 B2 3/2012 Budde et al.
9,234,329 B2 * 1/2016 Jaliwala ..... G01S 19/14
9,469,972 B2 * 10/2016 Ge ..... F16H 59/14
9,809,955 B2 * 11/2017 Wright ..... G05G 1/04
11,449,089 B1 * 9/2022 Seeger ..... G05G 9/047

FOREIGN PATENT DOCUMENTS

JP H07268897 A * 10/1995
JP 2000087908 A * 3/2000
WO WO 2007/144629 12/2007
WO WO-2019134735 A1 * 7/2019

* cited by examiner

| Operator Motion | Excavator Motion |
|---|---|
| Wrist Curl In (Flexion) /Forearm Pull Rearward | Bucket + Stick + Boom Digging /Retraction Motion |
| Wrist Curl Out (Extension) / Forearm Push Forward | Bucket + Stick +Boom Dumping / Extension Motion |
| Hand Move Left | Swing Left |
| Hand Move Right | Swing Right |

FIG. 8

ONE-HANDED JOYSTICK WITH ADAPTIVE CONTROL

CROSS-REFERENCES TO RELATED APPLICATIONS

This is a continuation-in-part patent application, which takes priority from patent application Ser. No. 17/404,262, filed on Aug. 17, 2021.

BACKGROUND OF THE INVENTION

1. Field of the Invention

The present invention relates generally to heavy equipment and more specifically to a one-handed joystick with adaptive control, which reduces the number of hand and arm motions required to operate an excavator.

2. Discussion of the Prior Art

Existing SAE joystick motion patterns and ISO joystick motion patterns for controlling an excavator require a steep learning curve for new operators. The existing motions are not very intuitive for two hand operation. Many of the joystick motions do not mimic the motion of an excavator. Further, the existing SAE joystick patterns and ISO joystick patterns are based on utilizing two joysticks. A specially designed joystick would allow the operator to execute additional motion commands not possible with current joysticks. Patent no. 5223776 to Radke et al. discloses a six-degree virtual pivot controller. Patent no. 7113836 to Hornig discloses a control device for maneuvering an apparatus. Patent document no. WO 2007/144629 to Clough et al. discloses a control system for earth moving and working apparatus. Patent no. 8135518 to Buddle et al. discloses a linkage control system with position estimator backup.

Accordingly, there is clearly felt need in the art for a one-handed joystick with adaptive control, which reduces the number of hand and arm motions required to operate an excavator; makes joystick motions more closely resemble the motions of an excavator for operators with limited or no experience; and allows the operator to execute additional motion commands in SAE or ISO motion patterns.

SUMMARY OF THE INVENTION

The present invention provides a one-handed joystick with adaptive control, which makes motions of the joystick more closely resemble the motions of an excavator for an operator with limited or no experience. A joystick having increased control functionality (improved joystick) preferably includes a state-of-the art joystick base for heavy equipment (industrial joystick base), which includes two axis functionality and a rotary upper handle. The rotary upper handle preferably includes an outer base ring, a rotatable ring, a position sensor and a base portion. The base portion extends downward from a bottom of the outer base ring. A bottom of the base portion is engaged with a top of the industrial joystick base. The rotatable ring is rotatably retained in an inner perimeter of the outer base ring. The outer base ring preferably includes opposing grooves for preventing axially movement of the rotatable ring. One of the opposing grooves is preferably retained in detachable ring. The detachable ring is secured to one side of the outer base ring with any suitable attachment method, such as fasteners, a bonding agent, a snap arrangement or any other suitable attachment method.

A sensor cavity is formed in an inner perimeter of the outer base ring, below the grooves for receiving the rotatable ring. The position sensor is preferably a PCAP (projective capacitive) touch sensor. However, other types of sensors may also be used. The rotatable ring preferably includes a ring portion and a rotatable cylinder bar. The ring portion preferably includes two halves. A pair of opposing bosses preferably extend inward from an inner perimeter of the ring portion. A through hole is formed through the pair of opposing bosses. The rotatable cylinder bar includes an inner diameter. The inner diameter of the rotatable cylinder bar is sized to rotatably receive an outer diameter of the pair of opposing bosses. A contact plug is preferably pressed into the inner diameter of the rotatable cylinder bar. However, the contact plug may be molded into the inner perimeter of the rotatable cylinder bar. The contact plug includes a biased center conductive contact and a biased peripheral conductive contact. The heights of the center and peripheral conductive contacts are equal. It is preferable to use a compression spring to bias the center and peripheral conductive contacts outward to contact the position sensor. The ring portion with the rotatable cylinder bar retained therein is inserted into the inner perimeter of the outer base ring. The detachable ring is secured to one side of the outer base ring. The center and peripheral conductive contacts must make physical contact with the position sensor.

The wiring from the position sensor may be run down a side of the outer base ring or molded into rotary upper handle. The wiring is connected to a suitable ring controller for determining the location of the rotatable cylinder bar and the rotatable ring. The position sensor includes a grid arrangement, which allows a rotational position and an angular position of the two-spring loaded conductive contacts to be determined. When the rotatable cylinder bar is rotated in either a clockwise or counterclockwise direction, the center conductive contact will remain relatively stationary, while the peripheral conductive contact will rotate about the center conductive contact. The rotational motion of the rotatable cylinder bar will be picked-up by the ring controller and could be used to control curling or dumping of a bucket. When the rotatable ring is rotated in either a clockwise or counterclockwise direction the angular motion will be picked-up by the ring controller and could be used to control boom-up or boom-down.

The adaptive joystick preferably includes the rotatable cylinder bar, an outer base ring, an inner ring and the industrial joystick base. A motion following adaptive controller (adaptive controller) receives an output from the joystick. The adaptive controller outputs at least one control signal to at least one of solenoid, which controls at least one hydraulic cylinder. An angle sensor, a depth sensor and a pressure sensor are used to monitor a position of each hydraulic cylinder. Outputs of the angle, depth and pressure sensors are inputted by a feedback device. An output of the feedback device is fed into the adaptive controller. The rotatable ring of the improved joystick is replaced with an inner ring. The inner ring may be rigidly retained relative to the outer base ring, or allowed to pivot in the outer base ring. An ISO/SAE button may be formed in the rotatable cylinder bar. A cylinder bar button is preferably formed in the rotatable cylinder bar adjacent the ISO/SAE button.

An inward wrist curl of the rotatable cylinder bar combined with a forearm pull rearward of the outer base ring are used to cause a bucket, stick and boom to create a digging motion, when the cylinder bar button is enabled. An outward wrist curl of the rotatable cylinder bar combined with a forearm push forward of the outer base ring are used to cause the bucket, stick and bucket to create a dumping motion, when the cylinder bar button is enabled. Moving the outer base ring to the left causes the excavator to swing to the left. Moving the outer base ring to the right causes the excavator to swing to the right. Rearward and forward motions of the outer base ring combined with inward and outward twisting of the rotatable cylinder bar are inputted by the adaptive controller. As time progresses, the movements of the adaptive joystick more closely to resemble the motion of the bucket, stick and boom in digging or dumping.

Accordingly, it is an object of the present invention to provide a joystick having increased control functionality having a unique moving structure, which allows more functions to be performed by one hand.

It is another object of the present invention to provide a one-handed joystick for excavators, which makes motions of the joystick more closely resemble the motions of an excavator for an operator with limited or no experience.

Finally, it is another object of the present invention to provide a one-handed joystick for excavators, which allows the operator execute additional motion commands as SAE or ISO patterns.

These and additional objects, advantages, features and benefits of the present invention will become apparent from the following specification.

BRIEF DESCRIPTION OF THE DRAWINGS

FIG. 8 is a table of hand and forearm motions associated with movements of an excavator of an adaptive joystick in accordance with the present invention.

DETAILED DESCRIPTION OF THE PREFERRED EMBODIMENTS

Figure 1:
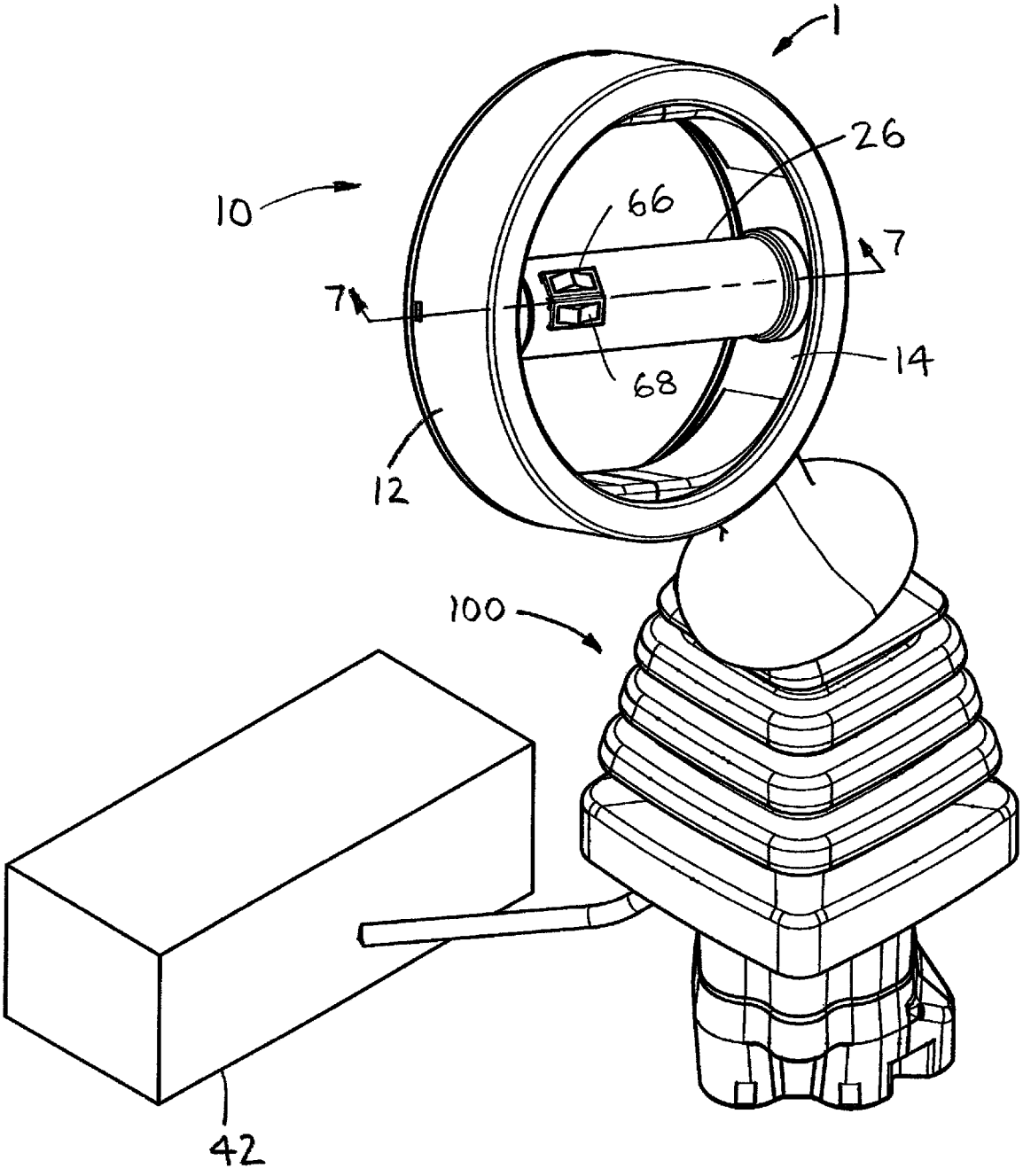
FIG. 1 is a perspective view of an improved joystick in accordance with the present invention.
Figure 2:
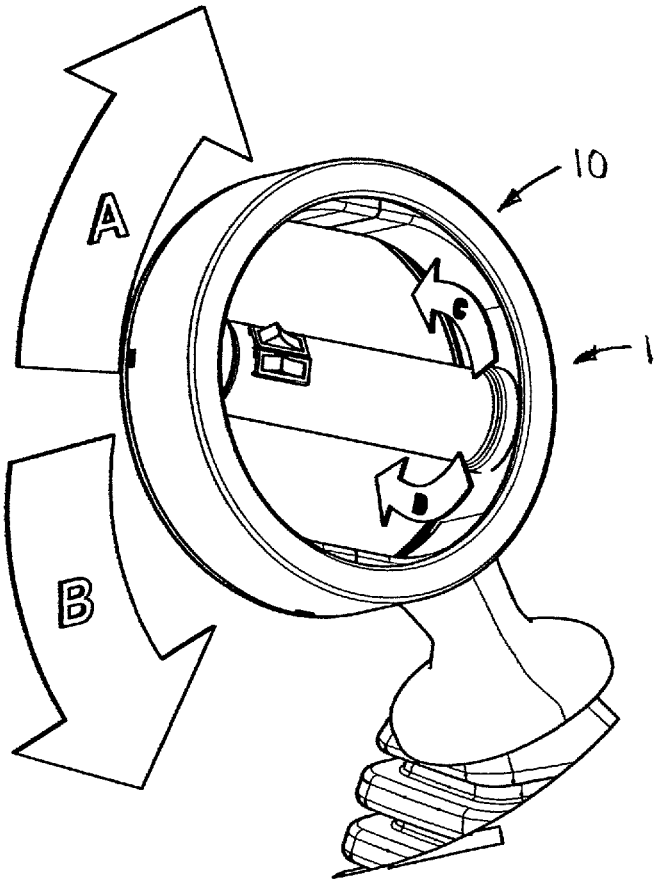
FIG. 2 is a perspective view of an improved joystick illustrating rotation of a ring portion and a rotatable cylinder bar in accordance with the present invention.
Figure 3:
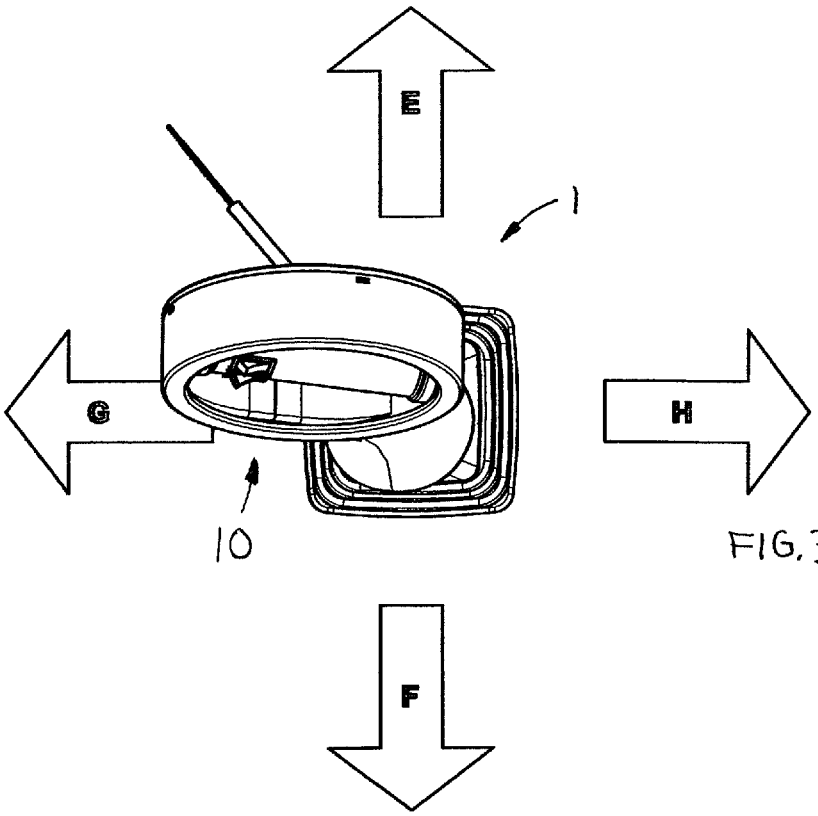
FIG. 3 is a perspective view of an improved joystick illustrating x-axis motion and y-axis motion of a rotary upper handle in accordance with the present invention.
Figure 4:
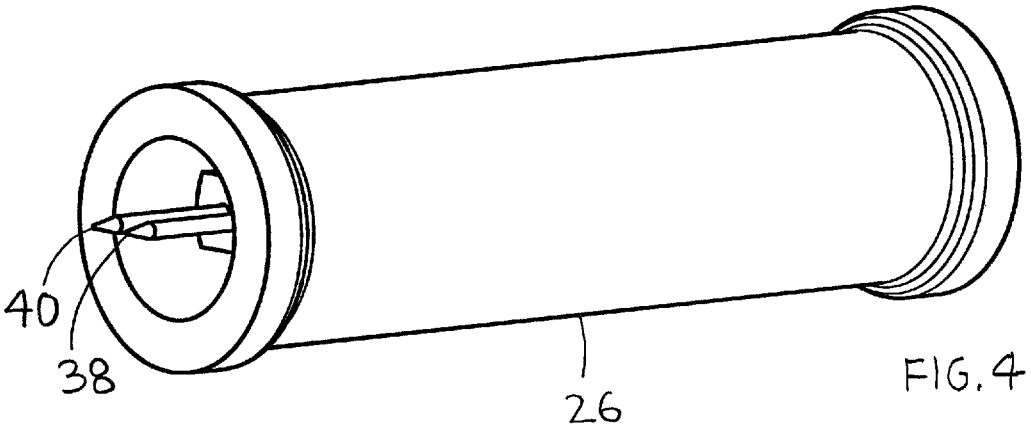
FIG. 4 is a perspective view of a rotatable cylinder bar of an improved joystick in accordance with the present invention.
Figure 5:
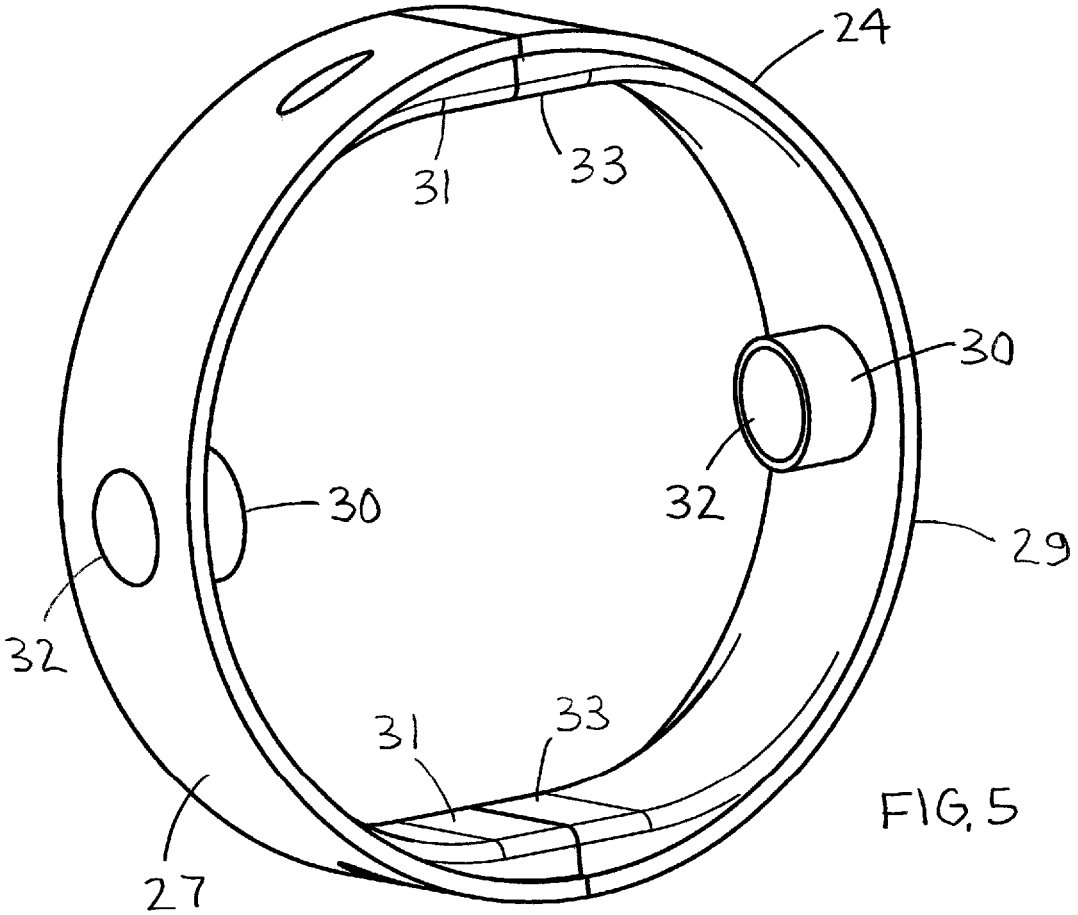
FIG. 5 is a perspective view of a ring portion of an improved joystick in accordance with the present invention.
Figure 6:
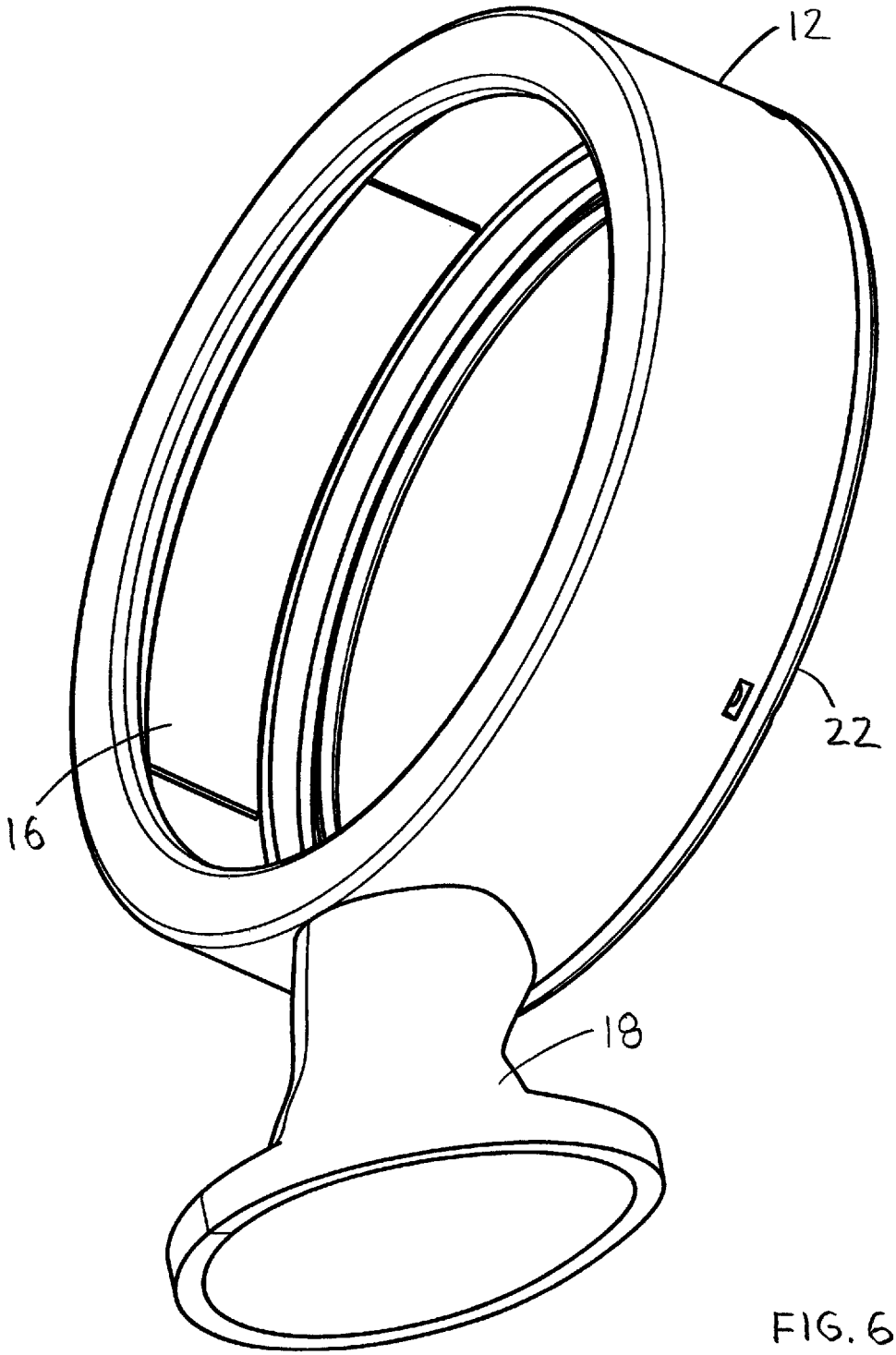
FIG. 6 is a perspective view of an outer base ring of an improved joystick in accordance with the present invention.
Figure 7:
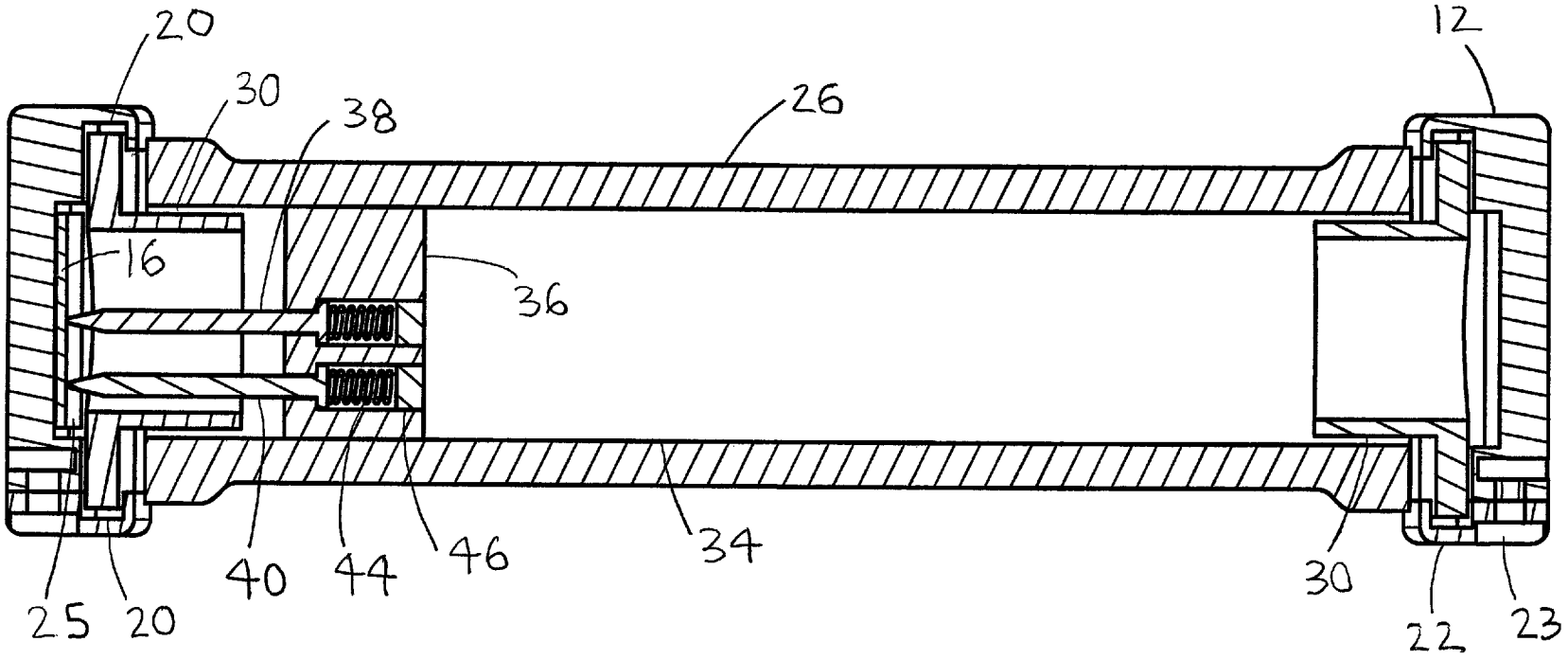
FIG. 7 is a cross-sectional view of a rotary upper handle of an improved joystick in accordance with the present invention.

With reference now to the drawings, and particularly to FIG. 1, there is shown a perspective view of an improved joystick 1. With reference to FIGS. 2-3, the improved joystick (adaptive joystick) 1 preferably includes a state-of-the art joystick base for heavy equipment (industrial joystick base) 100 with x-axis and y-axis movement, and a rotary upper handle 10. There are numerous ways in the art of implementing a two-axis joystick. Therefore, a further explanation of the operation of a two-axis joystick is not necessary.

With reference to FIGS. 4-7, the rotary upper handle 10 preferably includes an outer base ring 12, a rotatable ring 14, a position sensor 16 and a base portion 18. A bottom of the base portion 18 extends from a top of the industrial joystick base 100. The outer base ring 12 extends upward from a top of the base portion 18. The rotatable ring 14 is rotatably retained in an inner perimeter of the outer base ring 12. The outer base ring 12 preferably includes a pair of opposing grooves 20 for preventing axial movement of the rotatable ring 14. One of the opposing grooves 20 is preferably retained in a detachable ring 22. The detachable ring 22 is secured to one side of the outer base ring with any suitable attachment device, such as a plurality of fasteners 23, a bonding agent, snap arrangement or any other suitable attachment method.

A sensor cavity 25 is formed in an inner perimeter of the outer base ring 12 and below a bottom of the pair of opposing grooves 20 for receiving the position sensor 16. The position sensor 16 is preferably a PCAP (projective capacitive) touch sensor. However, other types of sensors may also be used. The position sensor 16 must be curved along a lengthwise axis or be flexible to conform to an inner perimeter of the sensor cavity 25. The rotatable ring 14 preferably includes a ring portion 24 and a rotatable cylinder bar 26. A pair of opposing bosses 30 preferably extend inward from an inner perimeter of the ring portion 24. A through hole 32 is formed through the pair of opposing bosses 30.

The ring portion 24 preferably includes first and second halves 27, 29. Each end of the first half 27 includes an attachment area 31 for attaching an opposing half. Each end of the second half 29 includes an attachment area 33 for attaching an opposing half. The first and second halves 27, 29 may be attached to each other with fasteners, adhesive, snaps or any other suitable attachment method. A pair of opposing bosses 30 preferably extend inward from an inner perimeter of the ring portion 24. A through hole 32 is formed through the pair of opposing bosses 30. The rotatable cylinder bar 26 includes an inner diameter 34. The inner diameter 34 of the rotatable cylinder bar 26 is sized to rotatably receive an outer diameter of the pair of opposing bosses 30. A contact plug 36 is preferably pressed into the inner diameter 34 of the rotatable cylinder bar 26. However, the contact plug 36 may be molded into the inner perimeter of the rotatable cylinder bar 26. The contact plug 36 preferably includes a biased center conductive contact 38 and a biased peripheral conductive contact 40. However, the contact plug 36 may only include a center conductive contact 38, if an electrical output from the rotatable cylinder bar 26 is not needed. A compression spring 44 and set screw 46 are preferably used to bias the center and peripheral conductive contacts against the position sensor 16. The heights of the center and peripheral conductive contacts 38, 40 are equal.

The ring portion 24 with the rotatable cylinder bar 26 retained therein is inserted into the inner perimeter of the outer base ring 12. The detachable ring 22 is secured to one side of the outer base ring 12 with the plurality of fasteners 23. Sensor wiring (not shown) from the position sensor 16 is run down a side of the outer base ring 12 or molded into the rotary upper handle 10. However, the ring portion 24 may not rotate relative to the outer base ring 12 for some applications. The rotatable cylinder bar 26 would rotate with the center and peripheral conductive contacts 38, 40. The sensor wiring is connected to a suitable ring controller 42 for determining the location of the rotatable cylinder bar 26 and the rotatable ring portion 24. The position sensor 16 includes a grid arrangement, which allows a rotational position and an angular position of the ring portion 24 and the rotatable cylinder bar 26 to be determined. When the rotatable cylinder bar 26 is rotated in either a clockwise or counterclockwise direction, the center conductive contact 38 will remain relatively stationary, while the peripheral conductive contact 40 will rotate about the center conductive contact 38. The rotational motion of the rotatable cylinder bar 26 will be picked-up by the ring controller 42 and could be used to control curling or dumping of a bucket. When the rotatable ring 14 is rotated in either a clockwise or counterclockwise direction the angular motion will be processed by the ring controller 42 and could be used to control boom-up or boom-down. Movement of the rotary upper handle 10 in the X-axis and the Y-axis will also be processed by the ring controller 42 and used to operate the appropriate attachment. Buttons, toggle switches, thumb wheels and other control devices may also be added to the rotary upper handle 10.

Figure 10:
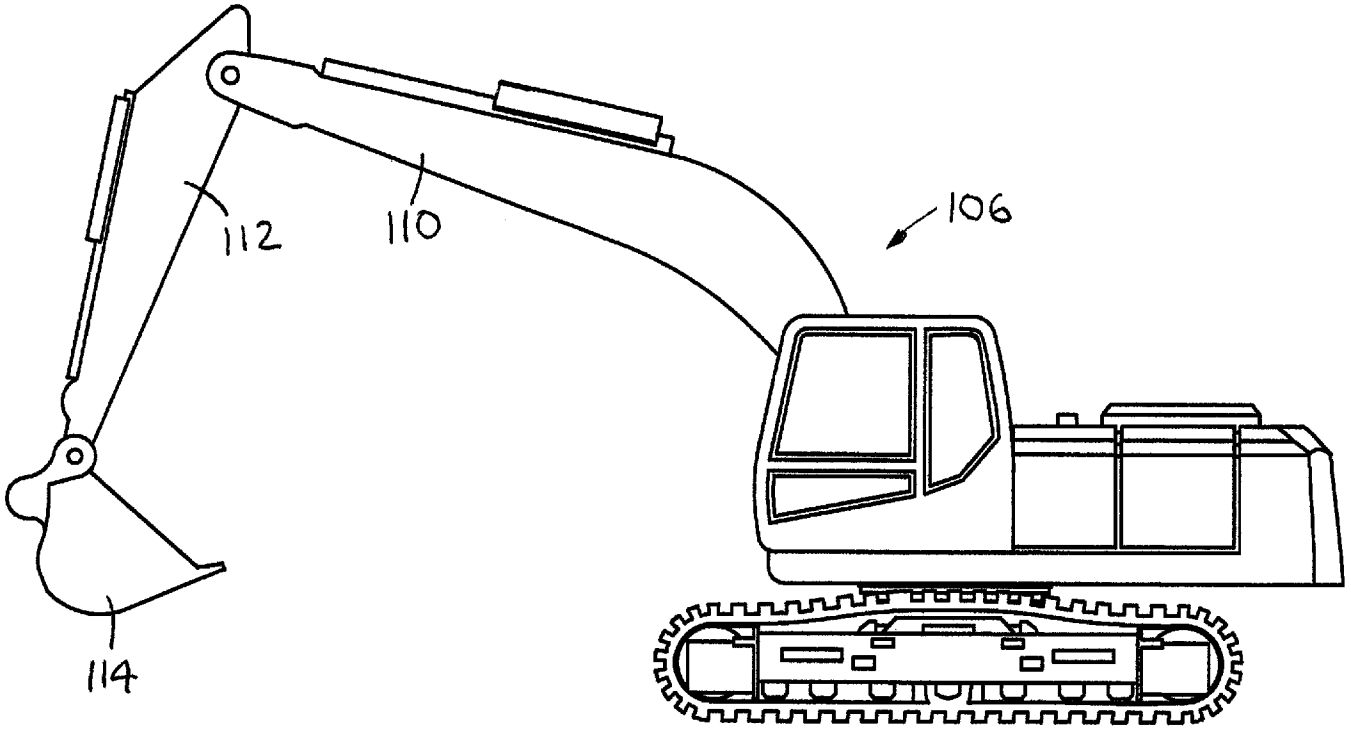
FIG. 10 is a side view of an excavator of an adaptive joystick in accordance with the present invention.

With reference to FIGS. 8 and 10, an inward wrist curl of the rotatable cylinder bar 26 combined with a forearm pull rearward of the outer base ring 12 are used to cause a bucket 114, a stick 112 and a boom 110 of the excavator 106 to create a digging motion, when a cylinder bar button 68 is enabled. An outward wrist curl of the rotatable cylinder bar 26 combined with a forearm push forward of the outer base ring 12 are used to cause the bucket 114, the stick 112 and the boom 110 to create a dumping motion, when the cylinder bar button 68 is enabled. Moving the outer base ring to the left causes the excavator 106 to swing to the left. Moving the outer base ring to the right causes the excavator 106 to swing to the right. Rearward and forward motions of the outer base ring 12 combined with inward and outward twisting of the rotatable cylinder bar 26 are inputted by the adaptive controller 48. As time progresses, the movements of the adaptive joystick 1 more closely to resemble the motion of the bucket 114, the stick 112 and the boom 110 in digging or dumping.

Figure 9:
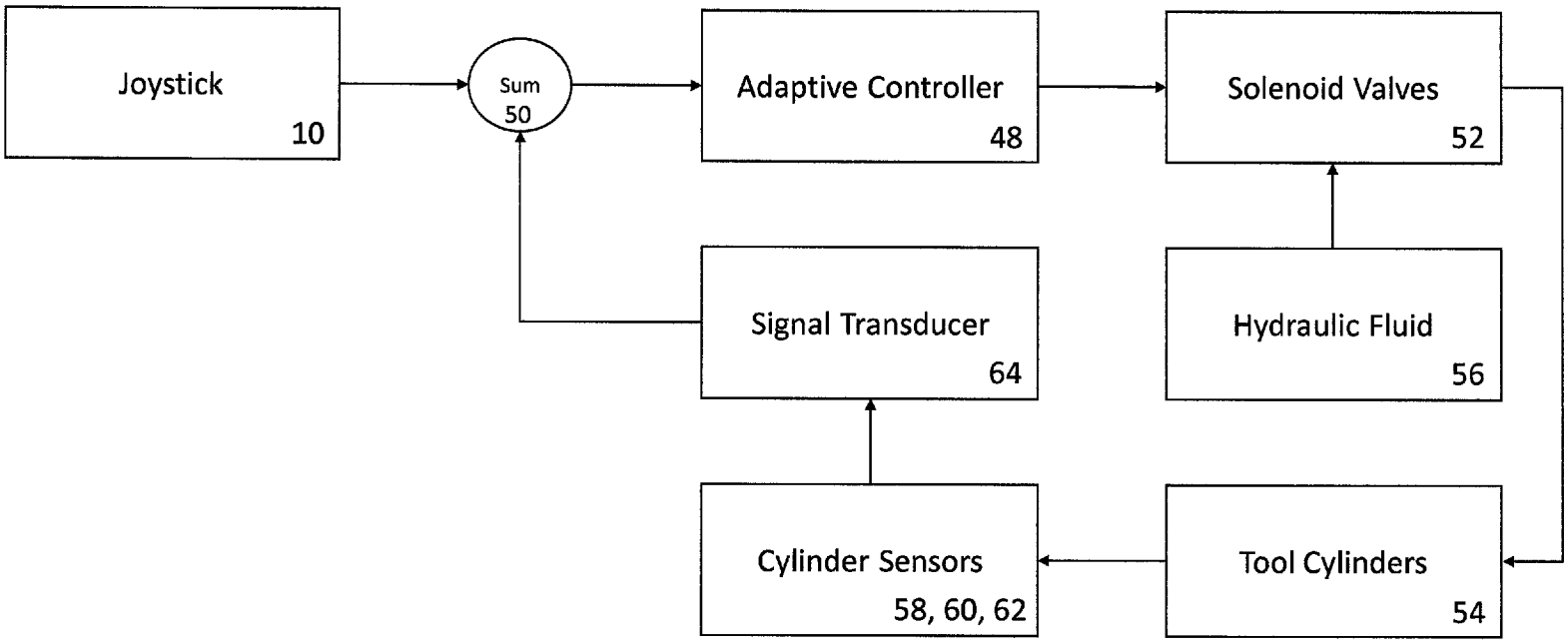
FIG. 9 is a schematic diagram of feedback loop of an adaptive controller receiving input from an adaptive joystick and a plurality of sensors in accordance with the present invention.

With reference to FIG. 9, the adaptive joystick 1 preferably includes the rotatable cylinder bar 26, the outer base ring 12, the inner ring 14 and the industrial joystick base 100. The rotatable ring of the adaptive joystick 1 is replaced with the inner ring 14. The inner ring 14 may be rigidly retained relative to the outer base ring 12, or allowed to pivot in the outer base ring 12. A motion following adaptive controller (adaptive controller) 48 receives an output from the adaptive joystick 10 through a summing junction 50. The adaptive controller 48 outputs at least one control signal to at least one solenoid valve 52, which controls at least one tool cylinder 54. The at least one solenoid valve 52 controls the flow of hydraulic fluid 56 to the at least one tool cylinder 54. Each tool cylinder 54 is preferably monitored by an angle sensor 58, a depth sensor 60 and a pressure sensor 62. The sensors 58, 60, 62 are used to monitor a position of each tool cylinder 54. Electrical outputs from the angle, depth and pressure sensors 56, 60, 62 are inputted by a signal transducer 64. The signal transducer 64 converts the sensor outputs into a form suitable for input by the adaptive controller 48 through the summing junction 50. As time progresses, the movements of the adaptive joystick 10 more closely to resemble the motion of the bucket, stick and boom of the tool in digging or dumping. An ISO/SAE button 66 is preferably formed in the rotatable cylinder bar. A cylinder bar button 68 is preferably formed in the rotatable cylinder bar adjacent the ISO/SAE button 66.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

What is claimed:

1. A joystick with adaptive control for operating a tool of an excavator, the tool includes a bucket, stick and boom, comprising:

a joystick base providing an electrical output for left, right, forward and rearward movement;

an outer base ring extends from a top of said joystick base;

at least one sensor provides an electrical output concerning at least one characteristic of at least one hydraulic cylinder of the tool;

a rotatable cylinder bar is rotatably retained in said outer base ring, said rotatable cylinder bar is sized to be grasped, wherein rotation of said rotatable cylinder bar in conjunction with forward or rearward movement of said outer base ring causes the bucket, stick and boom to have a digging or dumping motion;

an adaptive controller controls the motion of the at least one hydraulic cylinder, said electrical output from said at least one sensor is combined with a joystick electrical output to provide a summed output, said summed output is fed into said adaptive controller to make a motion of the tool consistent with a motion of said joystick; and a signal transducer for converting an output of said at least one sensor into a form suitable for input by said adaptive controller.

2. The joystick for operating a tool of an excavator of claim 1 wherein:

a left movement of said joystick base is associated with swinging the excavator in a leftward direction.

3. The joystick for operating a tool of an excavator of claim 1 wherein:

a right movement of said joystick base is associated with swinging the excavator in a rightward direction.

4. The joystick for operating a tool of an excavator of claim 1 wherein:

said at least one sensor measures at least one of angle, depth and pressure of the at least one hydraulic cylinder.

5. The joystick for operating a tool of an excavator of claim 1 wherein:

a lengthwise axis of said rotatable cylinder bar is disposed in a horizontal orientation during rotation.

6. A joystick with adaptive control for operating a tool of an excavator, the tool includes a bucket, stick and boom, comprising:

a joystick base providing an electrical output for left, right, forward and rearward movement;

an outer base ring extends from a top of said joystick base;

at least one sensor provides an electrical output concerning at least one characteristic of at least one hydraulic cylinder of the tool;

a rotatable cylinder bar is rotatably retained in said outer base ring, said rotatable cylinder bar is sized to be grasped, wherein rotation of said rotatable cylinder bar in one direction in conjunction with a forward movement of said outer base ring causes the bucket, stick and boom to have either a digging or dumping motion, rotation of said rotatable cylinder bar in an opposite direction in conjunction with a rearward movement of said outer base ring causes the bucket, stick and boom to have either a dumping or digging motion;

an adaptive controller controls the motion of the at least one hydraulic cylinder, said electrical output from said at least one sensor is combined with a joystick electrical output to provide a summed output, said summed output is fed into said adaptive controller to make a motion of the tool consistent with a motion of said joystick; and a signal transducer for converting an output of said at least one sensor into a form suitable for input by said adaptive controller.

7. The joystick for operating a tool of an excavator of claim 6 wherein:

a left movement of said joystick base is associated with swinging the excavator in a leftward direction.

8. The joystick for operating a tool of an excavator of claim 6 wherein:

a right movement of said joystick base is associated with swinging the excavator in a rightward direction.

9. The joystick for operating a tool of an excavator of claim 6 wherein:

said at least one sensor measures at least one of angle, depth and pressure of the at least one hydraulic cylinder.

10. The joystick for operating a tool of an excavator of claim 6 wherein:

a lengthwise axis of said rotatable cylinder bar is disposed in a horizontal orientation during rotation.

* * * * *